US007229143B2

(12) United States Patent
Gilman

(10) Patent No.: US 7,229,143 B2
(45) Date of Patent: Jun. 12, 2007

(54) REFRIGERATOR SHELF RETAINER ASSEMBLY

(75) Inventor: Barry E. Gilman, East Galesburg, IL (US)

(73) Assignee: Maytag Corporation, Newton, IA (US)

( * ) Notice: Subject to any disclaimer, the term of this patent is extended or adjusted under 35 U.S.C. 154(b) by 272 days.

(21) Appl. No.: 10/669,457

(22) Filed: Sep. 25, 2003

(65) Prior Publication Data

US 2005/0067929 A1 Mar. 31, 2005

(51) Int. Cl.
*A47B 96/04* (2006.01)
*E06B 1/00* (2006.01)

(52) U.S. Cl. ..... 312/405.1; 312/321.5; 312/319.1

(58) Field of Classification Search ..... 108/60, 108/61; 211/43, 59.3, 184, 51; 312/321.5, 312/351, 401, 404, 405.1, 408; 220/543, 220/544, 534, 536, 529
See application file for complete search history.

(56) References Cited

U.S. PATENT DOCUMENTS 452,673 A * 5/1891 Hunter ..... 108/61
497,993 A * 5/1893 Thomson ..... 211/51
1,271,508 A * 7/1918 Hall ..... 211/51
1,541,173 A * 6/1925 Ormond ..... 220/536
1,552,519 A * 9/1925 Ulrich ..... 40/360
2,020,514 A * 11/1935 Moffitt ..... 211/51
2,538,165 A * 1/1951 Randtke ..... 220/559
2,732,952 A * 1/1956 Skelton ..... 211/59.3
2,973,968 A * 3/1961 Behles ..... 280/104
3,028,014 A * 4/1962 Southwick ..... 211/59.3
3,339,222 A * 9/1967 Bauer et al. ..... 15/250.34
3,433,513 A * 3/1969 Hambly et al. ..... 403/66
3,848,745 A * 11/1974 Smith ..... 211/59.3
3,893,739 A 7/1975 Bernard
4,351,439 A 9/1982 Taylor
4,588,093 A * 5/1986 Field ..... 211/51
4,770,314 A * 9/1988 Giesler ..... 220/544
4,830,201 A 5/1989 Breslow
4,836,390 A * 6/1989 Polvere ..... 211/59.3
4,859,010 A * 8/1989 Jeziorowski ..... 312/321.5
4,907,707 A * 3/1990 Crum ..... 211/59.3
5,027,957 A * 7/1991 Skalski ..... 211/59.3
5,161,704 A * 11/1992 Valiulis ..... 211/184
5,209,360 A * 5/1993 Valiulis ..... 211/184
5,217,124 A * 6/1993 Stone ..... 211/184
5,240,126 A 8/1993 Foster et al.
5,655,670 A * 8/1997 Stuart ..... 211/43
5,671,851 A * 9/1997 Johnson et al. ..... 211/51
5,765,390 A 6/1998 Johnson et al.
5,871,104 A 2/1999 Martinez et al.
5,988,407 A * 11/1999 Battaglia ..... 211/51

(Continued)

FOREIGN PATENT DOCUMENTS

DE 2437550 A * 2/1976

(Continued)

*Primary Examiner*—Janet M. Wilkens
*Assistant Examiner*—Timothy M. Ayres
(74) *Attorney, Agent, or Firm*—Diederiks & Whitelaw, PLC

(57) ABSTRACT

A retainer assembly includes a divider element which is shiftably mounted to a shelving unit of a refrigerator. The divider element is biased toward one end of the shelving unit in order to urge food product containers, which are supported on the shelving unit, between a portion of the refrigerator and the divider element, thereby preventing undesired shifting of the food product containers relative to the shelving unit.

10 Claims, 3 Drawing Sheets

U.S. PATENT DOCUMENTS

| | | | | |
|---|---|---|---|---|
| 6,003,690 | A * | 12/1999 | Allen et al. | 211/51 |
| 6,109,458 | A * | 8/2000 | Walsh et al. | 211/59.3 |
| 6,220,684 | B1 * | 4/2001 | Bent et al. | 312/405.1 |
| 6,409,028 | B2 * | 6/2002 | Nickerson | 211/59.3 |
| 6,464,089 | B1 * | 10/2002 | Rankin, VI | 211/59.3 |
| 6,523,703 | B1 * | 2/2003 | Robertson | 211/59.3 |
| 2003/0020385 | A1 * | 1/2003 | Leimkuehler et al. | 312/405.1 |
| 2003/0080661 | A1 * | 5/2003 | Ahmed et al. | 312/405.1 |
| 2003/0102787 | A1 * | 6/2003 | Whitaker et al. | 312/405.1 |

FOREIGN PATENT DOCUMENTS

| | | | |
|---|---|---|---|
| DE | 4304502 | | 8/1994 |
| DE | 10121804 | A1 * | 11/2002 |
| EP | 83563 | A1 * | 7/1983 |
| EP | 0337340 | A2 * | 10/1989 |
| EP | 611535 | A1 * | 8/1994 |

* cited by examiner

REFRIGERATOR SHELF RETAINER ASSEMBLY

BACKGROUND OF THE INVENTION

1. Field of the Invention

The present invention pertains to the art of refrigerators and, more particularly, to an assembly for retaining food on a shelf in a refrigerator.

2. Discussion of the Prior Art

In the art of refrigerators, fresh food compartment doors are generally formed from an outer metal shell to which is attached a plastic inner wall defining liner. It is known to provide such liners with shelving units to support a wide range of food items. Such shelving units can be constituted by planar dike portions of the liner, pick-off buckets removably attached to the liner, or the like. In any case, when supporting food items on such shelving units, it is desirable to prevent the food items from becoming dislodged or shifting upon a sudden movement of the fresh food compartment door.

To prevent food items from undesirably shifting, it is known to employ a divider which essentially separates a storage shelving unit into various, smaller sections, thereby limiting the permissible shifting of food items stored thereon. It is also known to provide a slidable retainer in connection with a refrigerator shelving unit wherein the retainer can be manually slid into engagement with one or more food items supported on the shelving unit in order to limit shifting of the food items. One exemplary arrangement of this type is disclosed in connection with a dairy compartment in U.S. Pat. No. 5,765,390. In this and other known divider and retainer arrangements, it is imperative that the consumer force the divider or retainer snugly against the food items in order for the structure to function as desired.

Regardless of the availability of dividers and retainers for limiting the shifting of food items stored on refrigerator shelving units, there still exists a need in the art for a retainer assembly which will automatically function to limit the movement of food items stored on a shelving unit. Particularly, there exists a need for a versatile retainer assembly that can securely hold items of varying shapes and sizes in desired positions, while enabling the retainer assembly to be automatically repositioned when individual items are removed.

SUMMARY OF THE INVENTION

The present invention is directed to a retainer assembly for a shelving unit, such as a pick-off bucket, of a refrigerator. More particularly, a retainer member is shiftably mounted to a shelving unit, while being constantly urged toward one end of the shelving unit. In this way, the retainer assembly is biased against any food items placed on the shelving unit, between the end of the shelving unit and the retainer assembly. In accordance with one preferred form of the invention, the retainer assembly includes a snugger or divider element connected to a support arm which is preferably clipped over a front wall of a pick-off bucket provided on an inner door liner of a refrigerator fresh food compartment door. One end of a spring or biasing member is attached to the divider element and the other end of the spring member is attached to the bucket. The spring member automatically forces the divider element against food items located between the end of the bucket and the divider element, thereby securing the items against one end of the shelving unit.

Additional objects, features and advantages of the invention will become more fully apparent from the following detailed description of a preferred embodiment, when taken in conjunction with the drawings wherein like reference numerals refer to corresponding parts in the several views.

DETAILED DESCRIPTION OF THE PREFERRED EMBODIMENTS

Figure 1:
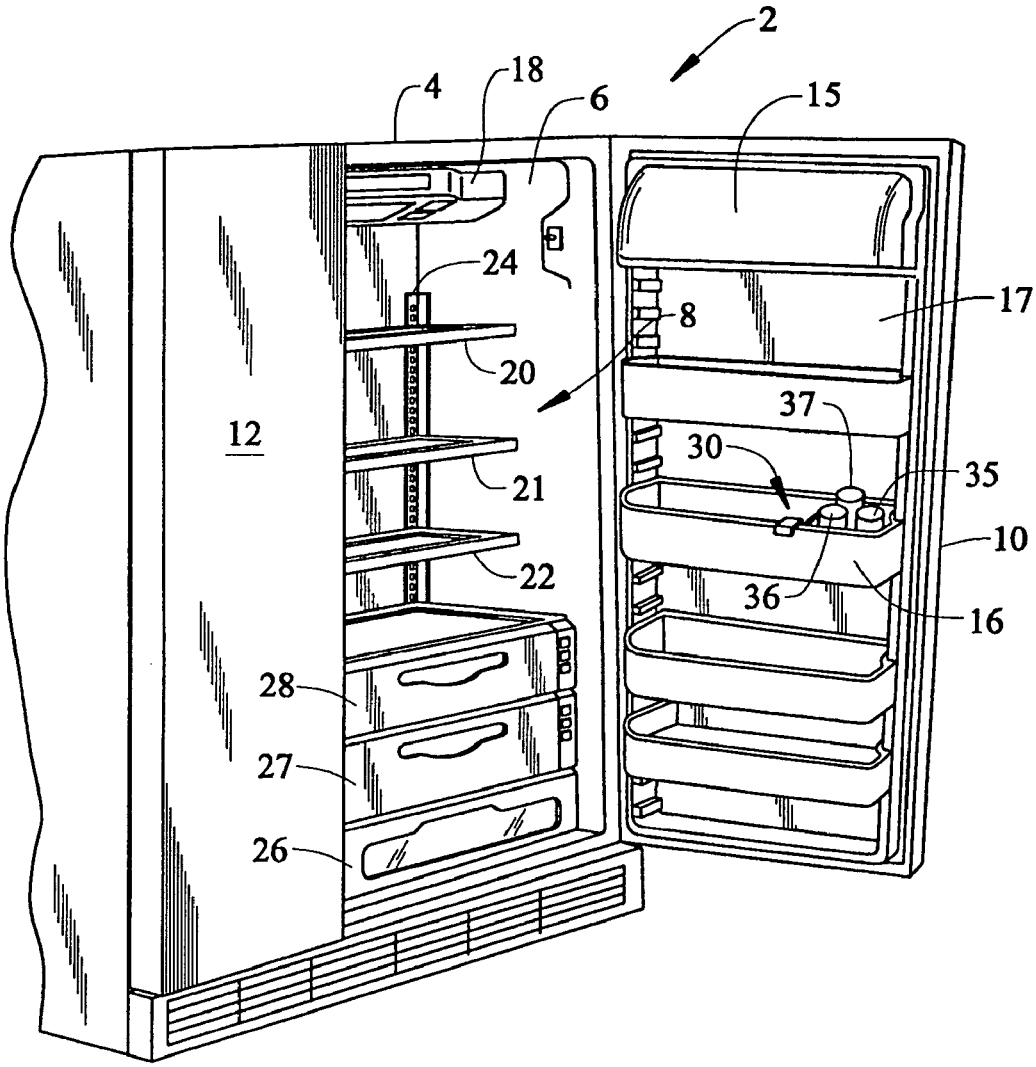
FIG. 1 is a perspective view of a side-by-side refrigerator incorporating a retainer assembly constructed in accordance with the present invention.

With initial reference to FIG. 1, a refrigerator cabinet 2 includes a cabinet shell 4 within which is positioned a liner 6 that defines a fresh food compartment 8. In a manner known in the art, fresh food compartment 8 can be accessed by the selective opening of a fresh food door 10. In a similar manner, a freezer door 12 can be opened to access a liner defined freezer compartment (not shown). For the sake of completeness, door 10 of refrigerator cabinet 2 is shown to include a dairy compartment 15 and various vertically adjustable shelving units, one of which is indicated at 16. As shown, shelving unit 16 constitutes a pick-off bucket that can be selectively removed from a liner 17 of door 10. Mounted in an upper region of fresh food compartment 8 is a temperature control housing 18 which, in a manner known in the art, can be used to regulate the temperature in both fresh food compartment 8 and the freezer compartment. Below temperature control housing 18 are arranged a plurality of vertically spaced shelves 20–22 which are preferably mounted for selective vertical adjustment upon rear rails, one of which is indicated at 24. At a lowermost portion of fresh food compartment 8 are illustrated various slidable bins, i.e., a lowermost bin 26 and higher, individually temperature controlled bins 27 and 28.

To this point, the above-described structure is known in the art and presented only for the sake of completeness. The present invention is actually directed to the incorporation of a retainer assembly, which is generally indicated at 30, within refrigerator cabinet 2. In the embodiment shown, retainer assembly 30 is used to maintain various food product containers 35–37 from undesirably shifting about shelving unit 16. However, as will become more fully evident below, retainer assembly 30 of the invention can be employed in connection with a wide range of shelving units.

Figure 2:
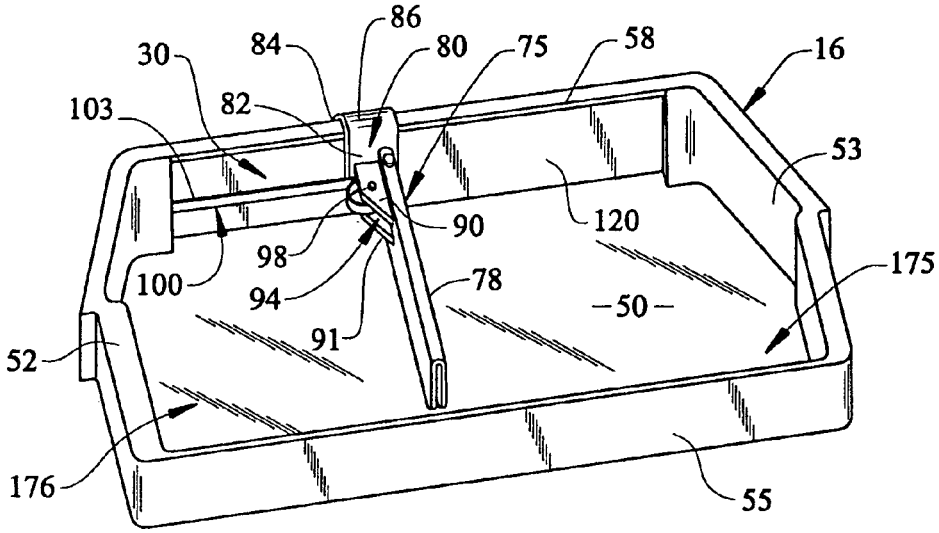
FIG. 2 is a upper perspective view of a pick-off bucket incorporating the retainer assembly of FIG. 1.
Figure 3:
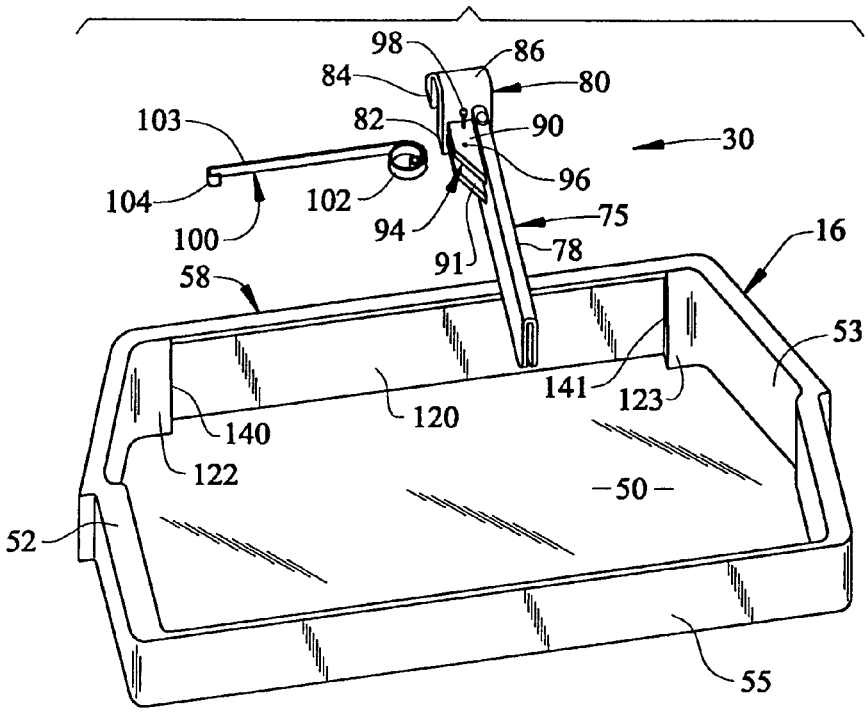
FIG. 3 is an exploded view of the pick-off bucket and retainer assembly of FIG. 2.
Figure 4:
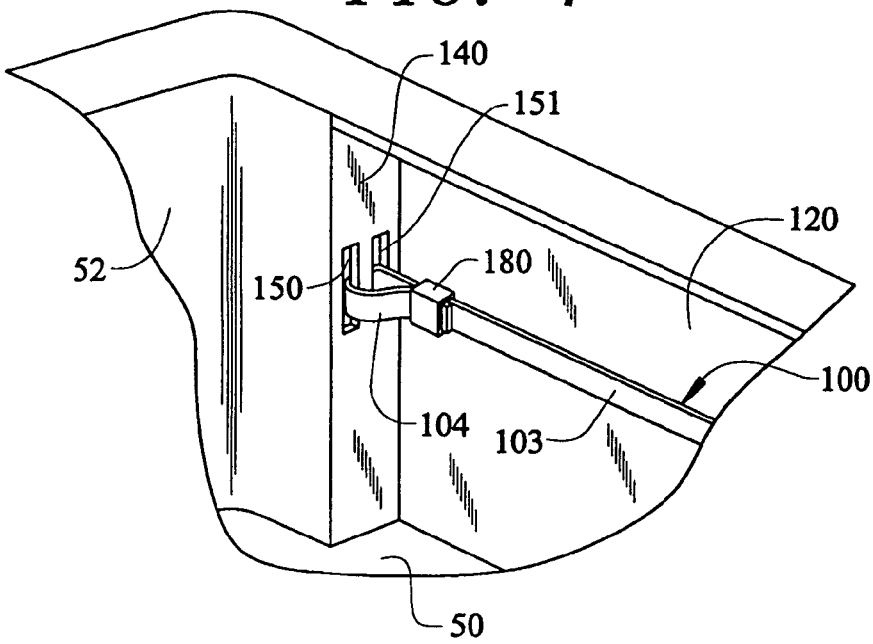
FIG. 4 is an enlarged perspective view illustrating the attachment of a spring member of the retainer assembly to the pick-off bucket of FIG. 3.

With reference to FIGS. 2–4, the structure and mounting of retainer assembly 30 in connection with shelving unit 16 will now be described. As indicated above, shelving unit 16 constitutes a pick-off bucket which is preferably, integrally molded of plastic to include a bottom 50, opposing side walls 52 and 53, a rear wall 55 and an upstanding front wall 58. The exact configuration of shelving unit 16 can greatly vary, particularly depending on the construction of liner 17 and the manner in which shelving unit 16 is attached thereto.

In any case, pick-off buckets and various other types of shelving units for refrigerator doors are widely known in the art. More importantly, in connection with the present invention, shelving unit 16 has slidably attached thereto a retainer member 75. In the embodiment shown, retainer member 75 includes a snugger or divider element 78 and a support arm 80. Most preferably, divider element 78 is integrally molded of plastic with support arm 80, although retainer member 75 could be formed from multiple, interconnected pieces. In general, support arm 80 includes a first end portion 82 from which projects divider element 78, a second end portion 84 which is shown to be spaced from and extend substantially parallel to first end portion 82, and an intermediate portion 86 interconnecting first and second end portions 82 and 84.

Extending along one side of divider element 78 and joining first end portion 82 of support arm 80 are a pair of substantially parallel tabs or plates 90 and 91. As depicted, plates 90 and 91 are vertically spaced so as to define a cavity 94 therebetween. In addition, plates 90 and 91 are preferably formed with a pair of aligned apertures, one of which is indicated at 96 in FIG. 3, for receiving a pin 98 as will be discussed more fully below. As also depicted in these figures, retainer assembly 30 includes a biasing member 100, shown here in the form of a spiral spring having a first coiled end portion 102, a substantially flat intermediate portion 103 and a second end portion 104.

As also shown, front wall 58 of shelving unit 16 is preferably formed with a recessed central section 120 which is intermediate end sections 122 and 123 that lead to side walls 52 and 53 respectively. Given this construction, front wall 58 defines a pair of laterally spaced, fore-to-aft extending front wall portions 140 and 141. As best shown in FIG. 4, portion 140 of front wall 58 is formed with a pair of spaced openings which preferably take the form of slots 150 and 151.

In use, retainer assembly 30 is attached to shelving unit 16, with support arm 80 being positioned over central section 120 of front wall 58 for sliding movement between points defined by end sections 122 and 123. Preferably, support arm 80 actually clips onto front wall 58. In any event, retainer assembly 30 is slidably attached to shelving unit 16 through support arm 80, while divider element 78 projects toward rear wall 55 of shelving unit 16. In this manner, divider element 78 separates shelving unit 16 into separate storage zones 175 and 176, with storage zones 175 and 176 having varying areas and volumes depending on the position of divider element 78. Therefore, divider element 78 can be shifted along a slide axis by a consumer in order to alter the particular storage configuration of shelving unit 16.

However, in accordance with the present invention, divider element 78 is also biased in one direction along the slide axis. More specifically, biasing member 100 extends between retainer member 75 and shelving unit 16 to urge divider element 78 in a particular direction. In the embodiment depicted, first coiled end portion 102 of biasing member 100 extends within cavity 94 between plates 90 and 91 and is retained therein with pin 98 extending through the middle of apertures 96 and the middle of first coiled end portion 102. On the other hand, second end portion 104 of biasing member 100 is looped through slots 150 and 151 and then joined together, such as through the use of a band 180 as best shown in FIG. 4.

With this construction, divider element 78 has a tendency to automatically shift along front wall 58 toward side wall 52 as biasing member 100 will look to assume a relaxed state wherein biasing member 100 is more coiled at end portion 102. However, divider element 78 can be selectively shifted away from side wall 52, against a biasing force associated with biasing member 100, to increase the length of intermediate portion 103. When food product containers 35–37 are arranged upon bottom 50 of shelving unit 16 between side wall 52 and divider element 78 as illustrated in FIG. 1, divider element 78 will automatically function to push food product containers 35–37 toward side wall 52 and into a snug configuration, thereby preventing undesirable shifting of food product containers 35–37 even when door 10 is abruptly opened and closed.

Figure 5:
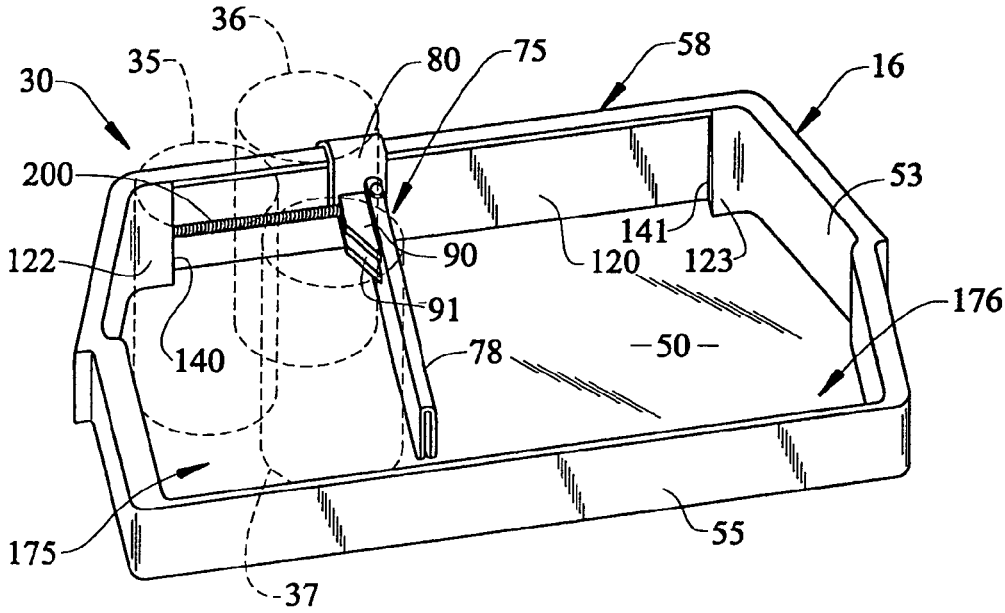
FIG. 5 is a perspective view, similar to that of FIG. 2, depicting another embodiment of the retainer assembly holding various food items at one end of the pick-off bucket.

Although described with reference to a preferred embodiment of the invention, it should be readily apparent that various changes and/or modifications can be made to the invention without departing from the spirit thereof. For instance, although retainer assembly 30 preferably employs a spiral spring having a flat intermediate portion which can advantageously be inconspicuously positioned close to front wall 58, other types of biasing arrangements could be employed. For example, FIG. 5 illustrates an alternative embodiment wherein a tension spring 200 is utilized to bias divider element 78. In addition, one or more elastic bands could be used to bias the divider element. It should also be recognized that the particular construction of the retainer assembly, as well as the manner and location of attachment of the retainer assembly to the shelving unit, can also vary in accordance with the invention. Furthermore, instead of employing a sliding connection with the shelving unit, the retainer member could be pivotally mounted for movement along a defined axis, while still being biased to a product retention posture. In any case, the invention is only intended to be limited to the scope of the following claims.

I claim:

1. A refrigerator comprising:

a cabinet shell;

a liner arranged in the cabinet shell and defining a food compartment;

a door attached to and movable relative to the cabinet shell in order to selectively access the food compartment;

at least one shelving unit provided in the food compartment, said at least one shelving unit including front, rear, bottom and opposing side walls and being adapted to support food items thereon; and a retainer assembly for securing food items on the at least one shelving unit, said retainer assembly including a divider element slidably mounted over an upper edge of the front wall for movement along a defined axis relative to the at least one shelving unit and dividing the at least one shelving unit into first and second laterally spaced storage zones, and a biasing member attached to the at least one shelving unit, extending along and closely adjacent to the front wall, and secured to the divider element so as to urge the divider element in a predetermined direction, wherein food items positioned on the at least one shelving unit are automatically engaged by the divider element in order to be maintained in a snug configuration in the first storage zone while maintaining the second storage zone available as additional storage space.

2. The refrigerator according to claim 1, wherein the retainer assembly further includes a support arm extending from the divider element, said support arm mounting the divider element for sliding movement relative to the at least one shelving unit.

3. A refrigerator comprising:

a cabinet shell;

a liner arranged in the cabinet shell and defining a food compartment;

a door attached to and movable relative to the cabinet shell in order to selectively access the food compartment;

at least one shelving unit provided in the food compartment, said at least one shelving unit including front, rear, bottom and opposing side walls and being adapted to support food items thereon; and a retainer assembly for securing food items on the at least one shelving unit, said retainer assembly including a divider element slidably mounted over an upper edge of the front wall for movement along a defined axis relative to the at least one shelving unit, and a biasing member attached to the at least one shelving unit, extending along and closely adjacent to the front wall, and secured to the divider element so as to urge the divider element in a predetermined direction, wherein food items positioned on the at least one shelving unit are automatically engaged by the divider element in order to be maintained in a snug configuration, wherein the retainer assembly further includes a support arm extending from the divider clement, said support arm mounting the divider element for sliding movement relative to the at least one shelving unit and wherein the at least one shelving unit is defined by a door pick-off bucket including at least one upstanding wall, said support arm being directly., slidably supported by the at least one upstanding wall.

4. The refrigerator according to claim 3, wherein the at least one upstanding wall constitutes a front wall of the door pick-off bucket.

5. A refrigerator comprising:

a cabinet shell;

a liner arranged in the cabinet shell and defining a food compartment;

a door attached to and movable relative to the cabinet shell in order to selectively access the food compartment;

at least one shelving unit provided in the food compartment, said at least one shelving unit including front, rear, bottom and opposing side walls and being adapted to support food items thereon; and a retainer assembly for securing food items on the at least one shelving unit said retainer assembly including a divider element slidably mounted over an upper edge of the front wall for movement along a defined axis relative to the at least one shelving unit, and a biasing member attached to the at least one shelving unit, extending along and closely adjacent to the front wall, and secured to the divider element so as to urge the divider element in a predetermined direction, wherein food items positioned on the at least one shelving unit are automatically engaged by the divider element in order to be maintained in a snug configuration, wherein the biasing member constitutes a spiral spring extending directly along a wall of the at least one shelving unit.

6. The refrigerator according to claim 5, wherein the spiral spring includes first and second end portions, with the first end portion being attached to the divider element and the second end portion being attached to the at least one shelving unit.

7. The refrigerator according to claim 1, wherein the retainer assembly further includes a pair of plates which are spaced so as to define a cavity therebetween, said biasing member including a first end portion which extends into the cavity.

8. The refrigerator according to claim 7, wherein the at least one shelving unit is formed with at least one opening, said biasing member including a second end portion directly attached to the at least one shelving unit through said opening.

9. The refrigerator according to claim 1, wherein the biasing member constitutes a tension spring.

10. A method of retaining food items on a shelving unit of a refrigerator comprising:

providing a shelving unit, including front, rear, bottom, and opposing side walls, for supporting food items in the refrigerator;

positioning food items on the shelving unit between a divider element slidably supported on an upper edge of the front wall of the shelving unit and a wall within the refrigerator, said divider element extending between the front and rear walls, thereby establishing first and second laterally spaced storage zones; and automatically, laterally shifting the divider element against the food items by biasing the divider element through the use of a spring member that is attached to the shelving unit, extends along and adjacent to the front wall, and is secured to the divider element in order to retain the food items in the first storage zone on the shelving unit in a snug configuration, while the second storage zone is maintained available as additional storage.

* * * * *